US005118450A

United States Patent [19]

Chiu

[11] Patent Number: 5,118,450

[45] Date of Patent: Jun. 2, 1992

[54] ROTATIONAL OXYGEN SUPPLY

[76] Inventor: Chih-Ming Chiu, P.O. Box 82-144, Taipei, Taiwan

[21] Appl. No.: 566,074

[22] Filed: Aug. 13, 1990

[51] Int. Cl.[5] ..... B01F 3/04

[52] U.S. Cl. ..... 261/142; 261/120; 210/242.2

[58] Field of Search ..... 261/120, 142; 210/242.2

[56] References Cited

U.S. PATENT DOCUMENTS 3,595,538 7/1971 Baumann ..... 261/120
4,229,302 10/1980 Molvar ..... 261/120
4,409,107 10/1983 Busch ..... 261/120
4,514,343 4/1985 Cramer et al. ..... 261/120
4,587,064 5/1986 Blum ..... 210/242.2
4,710,325 12/1987 Cramer et al. ..... 210/242.2

*Primary Examiner*—Tim Miles
*Attorney, Agent, or Firm*—Alfred Lei

[57] ABSTRACT

This invention relates to a rotational oxygen supply including a fixed pipe connected to a pipe bend via an electrical connector, a float having two containers between which there are two plates, a bubble generator having a reinforcing axle connected with the adjusting screw of the float, a propeller connected with the tubular axle, a L-shaped hood enclosing the propeller for fish or the like entering therein and a hot air pipe vertically mounted on the reinforcing axle and in communication with inlet holes of the tubular axle.

1 Claim, 3 Drawing Sheets

ROTATIONAL OXYGEN SUPPLY

BACKGROUND OF THE INVENTION

It is found that the commonly used oxygen supply (see FIG. 3) utilizes a motor 4 to drive an axle 42 and a bubble generator 45 to rotate so as to draw in air via the hole 43. As the bubble generator 45 rotates at a high speed, the air will flow out of the holes 46 to form bubbles which will then be cut into small bubbles by the blades 47. However, such oxygen supply cannot supply bubbles to everywhere of a raising pond and expel waste gas out thereof. Furthermore, the amount of oxygen dissolved in the raising pond and the temperature adjustment are limited.

It is, therefore, an object of the present invention to provide a rotational oxygen supply which may obviate and mitigate the above-mentioned drawbacks.

SUMMARY OF THE INVENTION

This invention relates to a rotational oxygen supply.

It is the primary object of the present invention to provide a rotational oxygen supply which may evenly supply oxygen to everywhere of a raising pond.

It is another object of the present invention to provide a rotational oxygen supply which may dissolve a large amount of oxygen into a raising pond thereby increasing the raising density.

It is still another object of the present invention to provide a rotational oxygen supply which may completely expel the waste gas out of the raising pond.

It is still another object of the present invention to provide a rotational oxygen supply which may adjust the temperature of the raising pond.

It is a further object of the present invention to provide a rotational oxygen supply which is economic to produce.

Other objects and merits and a fuller understanding of the present invention may be obtained by those having ordinary skill in the art when the following detailed description of the preferred embodiment is read in conjunction with the accompanying drawings.

DETAILED DESCRIPTION OF THE PREFERRED EMBODIMENT

Figure 1:
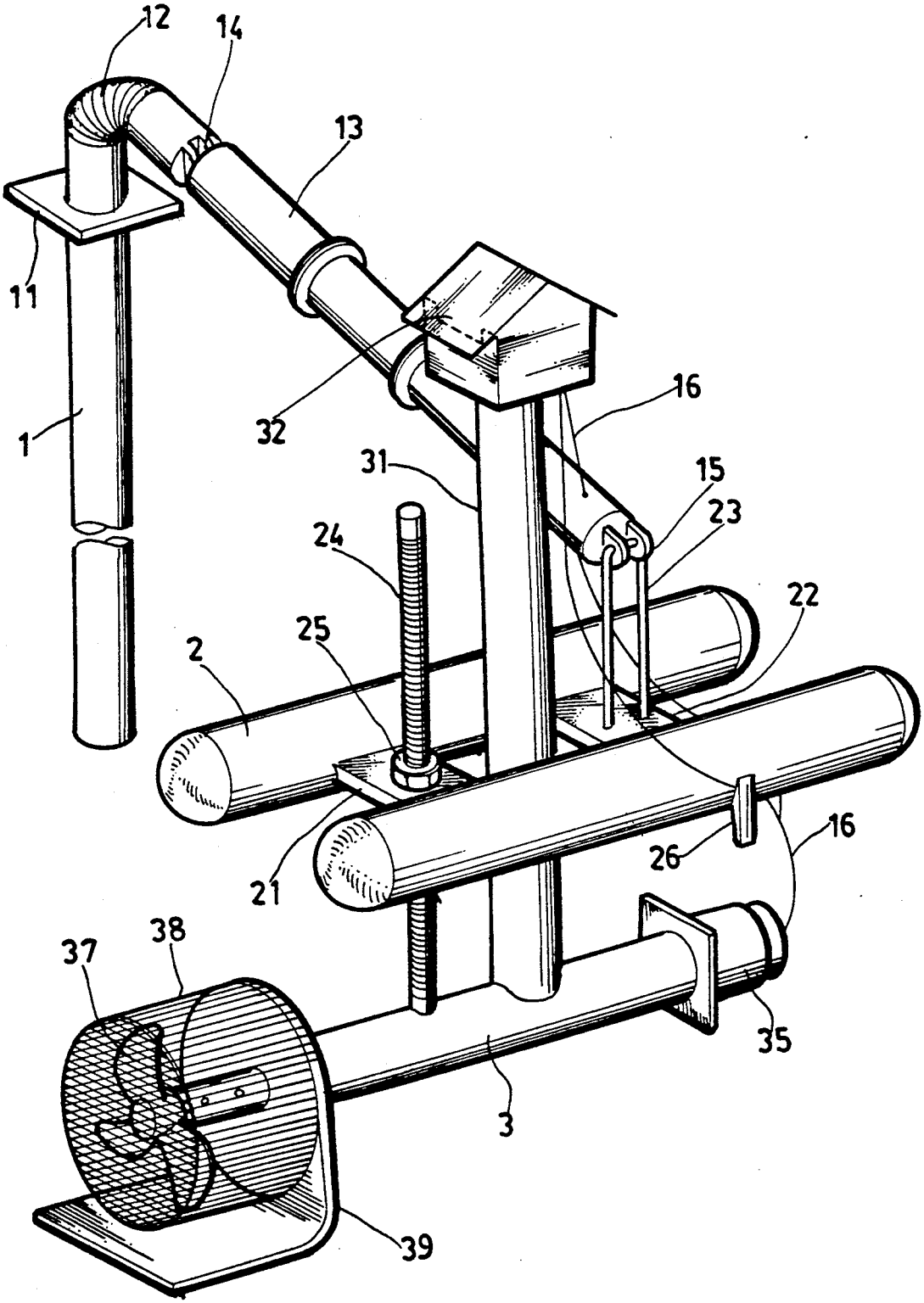
FIG. 1 is a perspective view of a rotational oxygen supply according to the present invention.
Figure 2:
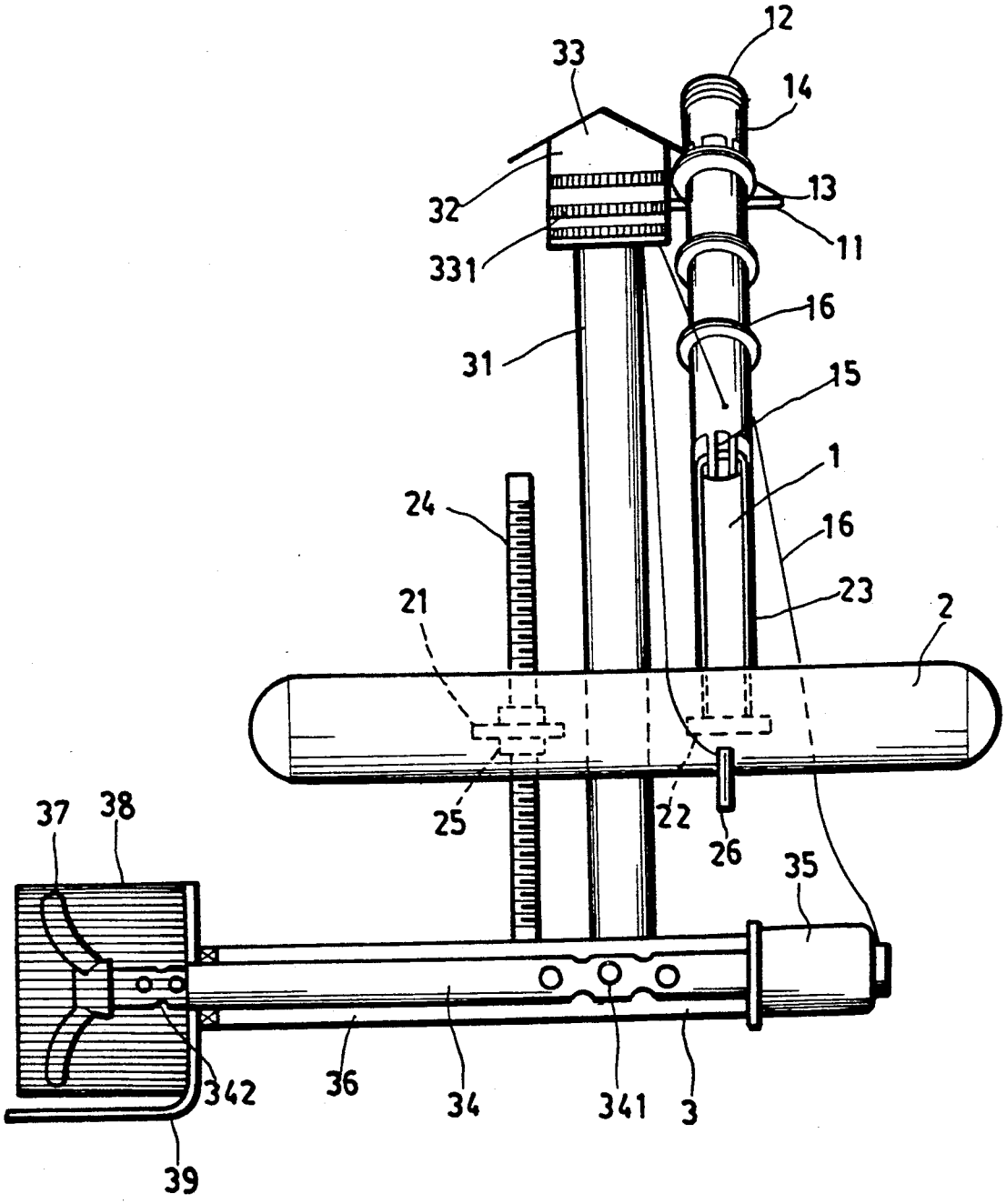
FIG. 2 is a front view of the rotational oxygen supply.
Figures 3A, 3B:
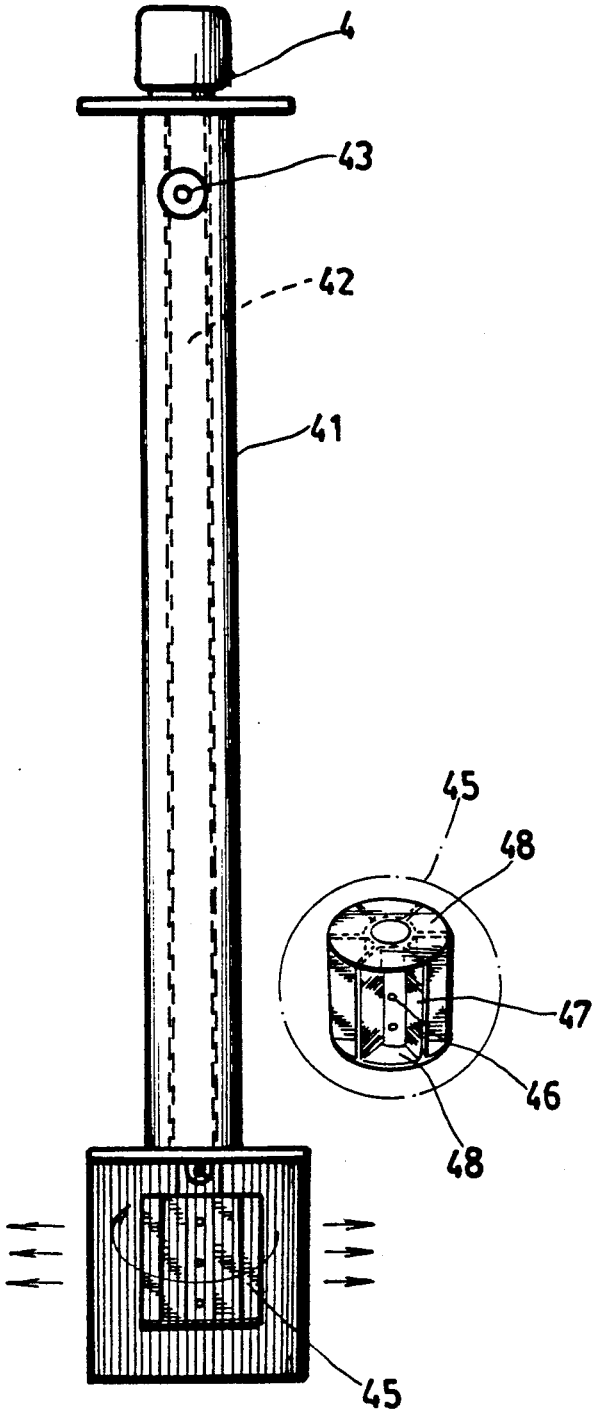
FIG. 3 shows a prior art oxygen supply.

With reference to FIGS. 1 and 2, the rotational oxygen supply according to the present invention mainly comprises a fixed pipe 1, a float 2 and a bubble generator 3. The fixed pipe 1 is fixedly mounted in the raising pond and provided with a movable electrical connector 11 which may be connected to a pipe bend 12 so that the power may be connected to an electrical wire 16 in the pipe bend 12 and a motor 35. The movable electrical connector 11 is well known in the art and has no need to be described here in detail. The pipe bend 12 is connected with an adjustable pipe assembly 13 via a pivot 14. The pipe assembly 13 may be increased or decreased in length as required and may rotate through 360 degrees with respect to the movable electrical connector 11.

The float 2 is composed of two floating containers between which there are two fixing plates 21 and 22. The fixing plate 22 is provided with a link 23 and a temperature controller 26. The link 23 is pivoted on the lug 15 of the pipe assembly 13 so that the angle between the link 23 and the pipe assembly 13 may be easily adjusted to adapt to the water level. The fixing plate 21 is provided with a screw 24 connected with a nut 25. The screw 24 is connected with a reinforcing pipe 36 of the bubble generator 36 and may be used to adjust the distance between the float 2 and the bubble generator 3.

The reinforcing pipe 34 of the bubble generator 3 is provided with a tubular axle 34 with a plurality of inlet holes 341 and outlet holes 342. The tubular axle 34 is rigidly fixed to the axle of the motor 35 at one end and a propeller 37 at the other. A L-shaped turbulence plate 39 which has a hood 38 for keeping fish or the like from entering therein is mounted under the propeller 37 with the hood 38 housing the outlet holes 342 of the tubular axle 34. A hot air pipe 31 is vertically mounted on the tubular axle 34, enclosing the inlet holes 341. On the top of the hot air pipe 31 there is a chamber 33 in which is mounted a heater 331 controlled by the temperature controller 26. As the temperature of the water is lower than 16 degrees, the heater 331 is actuated to supply hot air. When the temperature of the water is higher than 22 degrees, the heater 331 will be automatically stopped.

In operation, the motor 35 will drive the tubular axle 34 to rotate. Meanwhile, since the inside pressure of the tubular axle 34 is smaller than the outside pressure, the air will flow from the chamber 33 into the tubular axle 34 via the inlet holes 341 and out of the tubular axle 34 via the outlet holes 342. The air will then be in contact with the water, producing bubbles. As the tubular axle 34 rotates at a high speed, the propeller 37 will also rotate at a high speed thereby generating a strong current and therefore, separating the bubbles into many smaller bubbles. The smaller bubbles will be transmitted to a distance by the strong current and the L-shaped turbulence plate 39. Furthermore, due to the pushing force of the propeller 37, the bubble generator 3 and the float 2 will be pushed to turn around the fixed pipe 1 thereby transmitting a large amount of bubbles to everywhere of the raising pond. Besides, the temperature of the water may be adjusted as required.

Although the present invention has been described with a certain degree of particularity, it is understood that the present disclosure is made by way of example only and that numerous changes in the detail of construction and the arrangement and combination of parts may be resorted to without departing from the spirit and scope of the invention as hereinafter claimed.

I claim:

1. A rotational oxygen supply comprising:

a fixed pipe connected to a pipe bend via an electrical connector, said pipe bend being connected to an adjustable pipe assembly;

a float having two containers between which there are two fixing plates, one fixing plate being provided with a link and a temperature controller while the other with an adjusting screw;

a bubbles generator having a reinforcing axle connected with the adjusting screw of said float, said reinforcing axle being provided with a tubular axle with outlet holes and inlet holes;

a propeller connected with said tubular axle;

a L-shaped hood enclosing said propeller for keeping fish or the like from entering therein; and a hot air pipe vertically mounted on said reinforcing axle and in communication with inlet holes of said tubular axle.

* * * * *